US006877169B2

(12) United States Patent
Acquaviva

(10) Patent No.: US 6,877,169 B2
(45) Date of Patent: Apr. 12, 2005

(54) WINDBREAK EYE SHIELD

(76) Inventor: Jean-Noel Acquaviva, 25 Rue Carnot, 92100 Boulogne-Billancourt (FR)

( * ) Notice: Subject to any disclaimer, the term of this patent is extended or adjusted under 35 U.S.C. 154(b) by 79 days.

(21) Appl. No.: 10/210,030

(22) Filed: Aug. 2, 2002

(65) Prior Publication Data

US 2003/0028953 A1 Feb. 13, 2003

(30) Foreign Application Priority Data

Aug. 10, 2001 (FR) ..... 01 10712
Nov. 7, 2001 (FR) ..... 01 14371

(51) Int. Cl.[7] ..... A61F 9/02
(52) U.S. Cl. ..... 2/429
(58) Field of Search ..... 2/10, 422, 424

(56) References Cited

U.S. PATENT DOCUMENTS 4,546,498 A * 10/1985 Fantin ..... 2/424
5,131,101 A * 7/1992 Chin ..... 2/424
5,297,297 A * 3/1994 Pei ..... 2/424
5,398,341 A * 3/1995 Trapple ..... 2/8
5,467,480 A * 11/1995 Baudou et al. ..... 2/6.5
5,813,048 A * 9/1998 Thom ..... 2/6.5
6,161,225 A * 12/2000 Arai ..... 2/424
6,370,700 B1 * 4/2002 Arion ..... 2/424

* cited by examiner

*Primary Examiner*—Katherine M Moran
(74) *Attorney, Agent, or Firm*—Finnegan, Henderson, Farabow, Garrett & Dunner, L.L.P.

(57) ABSTRACT

The windbreak eye shield type assembly (10) comprises members (19, 19A) for mounting the shield (10) so as to be mobile on a helmet (1), so that the shield (10) can be moved away from the line of sight, under the control of wind pressure sensing members, remaining opposed to the wind.

17 Claims, 5 Drawing Sheets

WINDBREAK EYE SHIELD

FIELD OF THE INVENTION

The present invention relates to windbreak eye protecting shields.

Such transparent shields are fitted, for example, to helmets for the drivers of open vehicles. The shield, which is removable, forms a sort of crescent comprising two lateral ends hinging on the helmet in order for it to be brought down in front of the eyes, by a manual operation, into a functional protective position, or raised into rest position, visor-fashion.

However, the fogging, or condensation, due to perspiration impairs vision, with the result that the shield has frequently to be switched from one position to another, by temporarily raising it to obtain a better view of the scene observed by observing it directly from under the raised shield, and in order to aerate the rear of the shield.

These operations involving switching between the two positions are an inconvenience and even, in the present example, a danger, owing to the loss of attention that they occasion.

PRIOR ART

Document FR 2 541 092 discloses a suspended vertical shield, pivotally mounted on the upper edge of a viewing aperture in a full-face helmet. The shield is pressed, in closed position, against the lower edge by the pressure of the wind, against the bias of a return spring in a slightly parted position. Condensation is thus evacuated. However, the shield, in both its positions, remains in front of the eyes, since it provides only a small, downwards orientated aperture. Now, if the relative wind on the helmet is slight or null, for example if the wearer of the helmet is travelling slowly or is at a standstill, the condensation is not evacuated, or only very slowly.

Document FR 2 402 455 discloses a helmet bearing a lever including two descending lateral wings, rotatably mounted rearwards of a hinge axis of a shield on the helmet. The wings receive the wind on their lower faces and thus pivot upwards, aligning themselves on the horizontal direction of the longitudinal wind, arriving head on. As a result, the shield is pulled down over the eyes. Such an arrangement is insufficiently sensitive to a head wind, with the result that the shield remains raised at speeds at which it ought to protect the eyes. The whole is, moreover, cumbersome, and, what is more, disturbances to the path of the wind could cause unexpected flipping, as gusts of wind, lateral or descending, may change the anticipated direction of the wind, which is longitudinal, and raise the wings. In the event of a gust of wind in a transverse direction, the shield is thus liable to open, even at high wind speeds. A movement of the helmet wearer's head is liable to have the same disturbing effect. This arrangement does not, therefore, operate reliably.

SUMMARY OF THE INVENTION

The present invention aims to provide a shield type assembly offering better reliability in use.

For this purpose, the invention provides a windbreak eye shield type assembly, comprising means for mounting the shield to be mobile on a bearing member, arranged to co-operate with a user's head in order for the shield to be mobile between a functional position defining a given functional solid angle of vision, with protection for the user's eyes, and a rest position, corresponding to a corresponding rest solid angle smaller than the functional solid angle, under the control of wind pressure sensing means, characterised by the fact that the wind pressure sensing means are arranged to control the changeover from a predetermined one of said positions to the other while remaining opposed to the wind.

Thus, as the sensing means are opposed to the wind, that is to say longitudinally facing forwards, they present a maximum transverse profile in relation to the anticipated longitudinal direction of the wind. If the anticipated longitudinal wind, hence a wind with a purely head-on vectorial direction, changes and becomes oblique, acquiring a transverse vectorial component, as a consequence of a transverse gust, the sensing means still sense the longitudinal component of the wind. The sensing means thus have a cone of sensitivity, around the longitudinal direction of arrival of the wind that makes them remain functional.

The bearing member of such an assembly can be a helmet, a spectacle frame or the like.

BRIEF DESCRIPTION OF THE DRAWINGS

The invention will be more readily understood with the help of the following description of three preferred forms of embodiment of the shield type assembly of the invention, with reference to the annexed drawing, wherein.

DESCRIPTION OF THE PREFERRED FORMS OF EMBODIMENT

Figure 1:
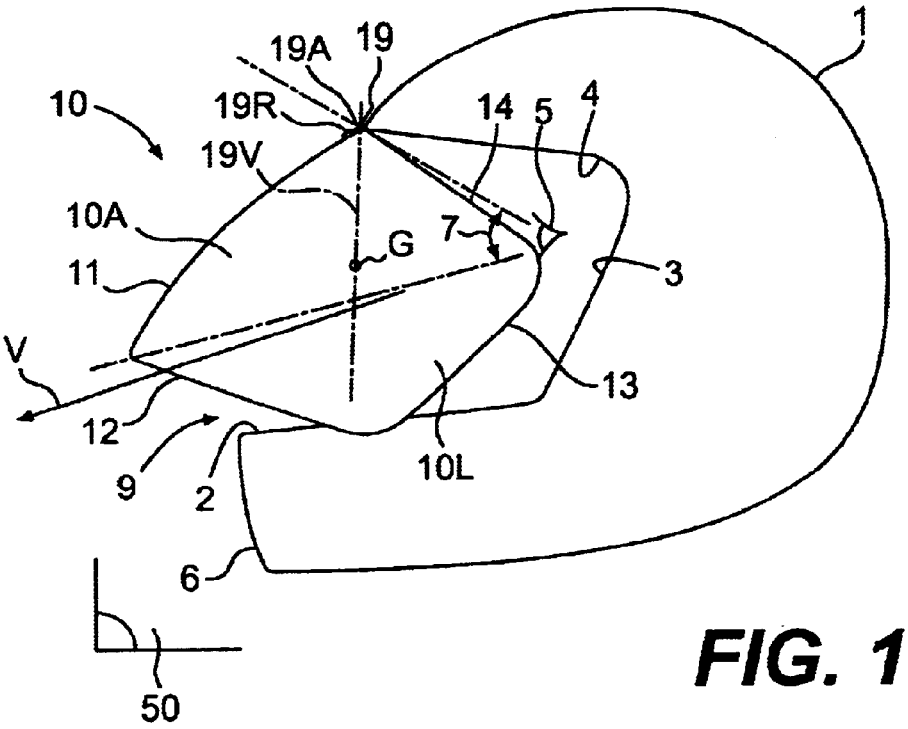
FIG. 1 is a side view of a full-face helmet comprising the shield type assembly of the invention, in open position, according to the first form of embodiment.

The helmet indicated by the reference 1 in FIG. 1, in this example a full-face helmet, bears a mobile windbreak eye shield 10, mainly constituted by a sheet or flap of transparent material shaped to close a conventional field of view aperture 9 of helmet 1. Shield 10 is of a shape that is intermediate between a sector of a sphere and a sector of a cylinder.

Shield 10 comprises a forward part 10A, with a front profile bearing reference number 11, and two rear lateral parts 10L, only one of which is visible here. Shield 10 is limited by a lower edge 12, two rear edges 13 and an upper edge 14, to which correspond, respectively, the following abutment edges: lower edge 2, rear edge 3 and upper edge 4 of aperture 9.

Shield 10 is mounted on helmet 1 by means of a hinge 19 which comprises a first member, fixed in the middle of the upper edge 14 of shield 10, and a second member, fixed in the middle of corresponding upper edge 4 of aperture 9. The hinge includes a pin (not shown) that provides an axis 19A for hinging the first and second members aforementioned, the pin axis 19A crossing perpendicularly a median plane 50 of symmetry of helmet 1, which is vertical in FIG. 1.

In FIG. 1, shield 10 is in the open, or rest, position, and does not, therefore, completely close aperture 9. The centre of gravity G of the material of which shield 10 is made is then located in a transverse vertical plane 19V, of suspension of shield 10, which plane passes through axis 19A. In the open position, shield 10 delimits a given solid angle 7 of protection of the eyes 5 of the wearer of helmet 1.

Figure 2:
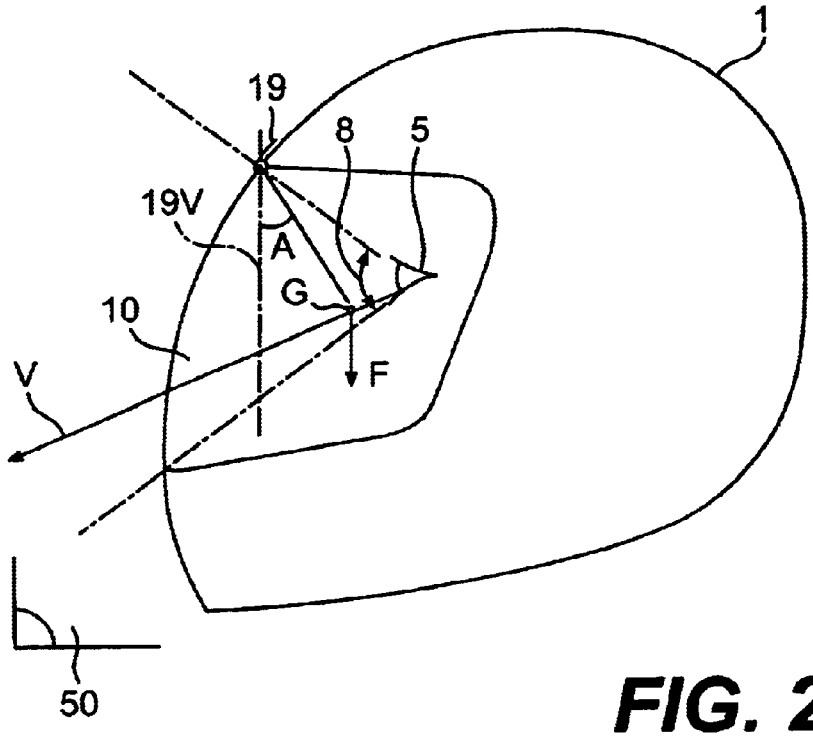
FIG. 2 corresponds to FIG. 1, with the shield in closed, functional position.

In the closed position of FIG. 2, the centre of gravity G has been shifted back behind plane 19V, through the effect of an external force, due to the pressure of the head wind on shield 10. The distance between the centre of gravity G and plane 19V then determines a moment or torque of restoration or bias towards the rest, or open, position of FIG. 1, which moment is overcome by the wind pressure force when the wind reaches a given relative speed, here about 20 km (12,50 miles) per hour. In the closed position, shield 10 determines another given solid angle 8 for the protection of eyes 5, greater than solid angle 7 since the lower edge of shield 10 has been pulled downwards. The restoring moment whereby shield 10 swings towards the open position is essentially due to the weight of lateral parts 10L, the mass of which is, globally, located well to the rear of plane of suspension 19V.

There is thus a solid angle of difference, between solid angles 7 and 8, forming a field of view that is direct, without passing through shield 10 in the raised, rest position, corresponding to direct lines of sight V. The solid angle of difference is limited by the lower edge 2 of aperture 9 and by lower edge 12 of shield 10.

To increase the pivoting angle of shield 10, centre of gravity G can be shifted towards the rear by means of an additional thickness of shield 10 in the zone of rear edge 13.

In closed position, forward part 10A of shield 10 is substantially perpendicular to the longitudinal direction of the wind, with the result that shield 10, thus opposed to the wind, still correctly senses the wind, even in the event of a lateral gust.

In the open position, shield 10 still partially has a surface oriented transversely to the wind to be subjected to an at least minimal moment of pressure force, which increases with speed and causes a changeover to the closed position.

Shield 10 thus forms a permanent wind sensor, which sensor always has an apparent surface that can be caught by the longitudinal wind, or a profile in a transverse vertical plane, a surface which is always opposed to the wind and which receives a vectorial pressure force therefrom, directed according to a vector passing beneath axis 19A and opposing the force of restoration to the rest position. Shield 10 thus directly forms a permanent sensor of wind intensity.

The swing of shield 10 into the open position has, in fact, two effects. First of all, this creates an air inlet via which the outside air can enter helmet 1, which removes condensation from shield 10. Furthermore, the wearer of helmet 1 can directly see the scene outside (lines of sight, like line V).

Figure 3:
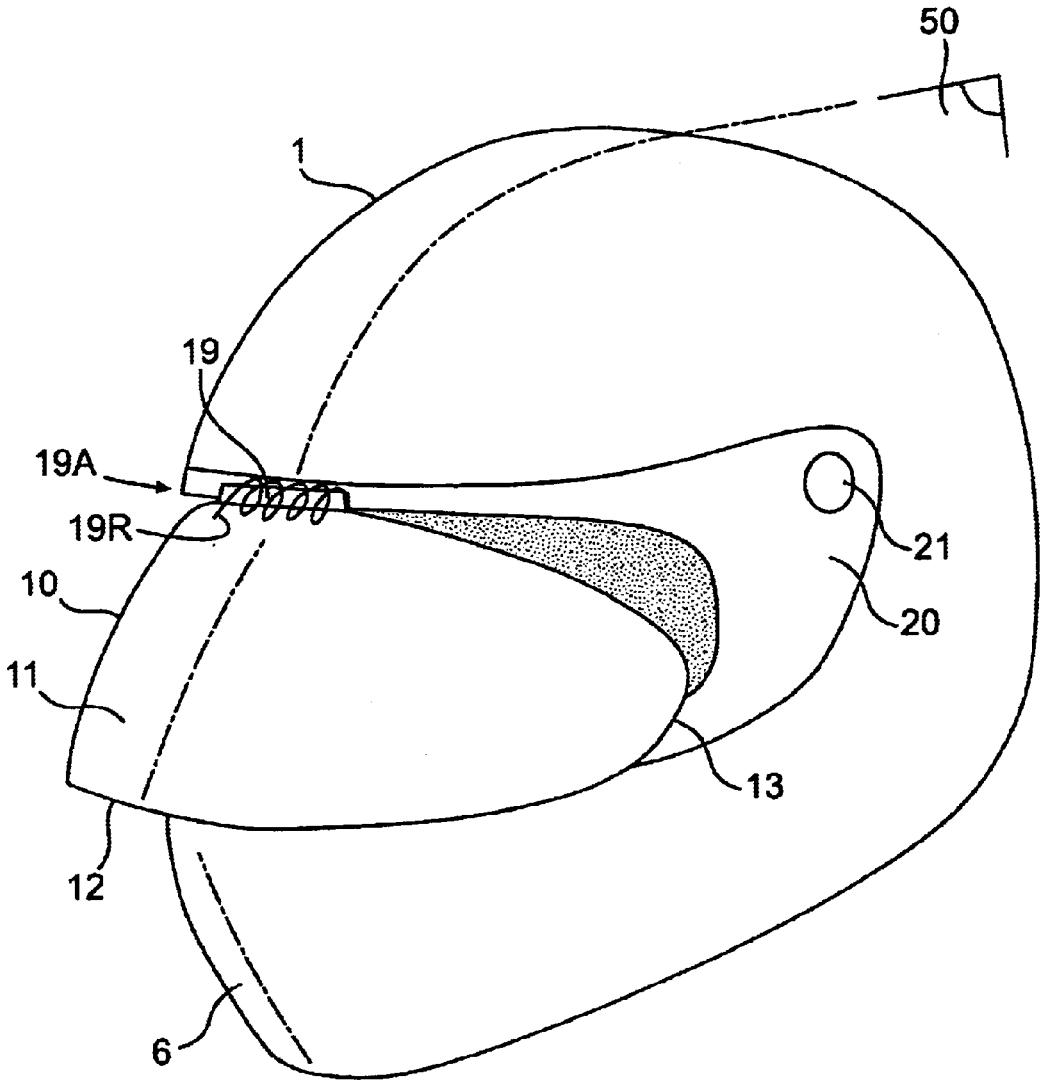
FIG. 3 is a three quarter front view of the same full-face helmet in the second form of embodiment of the shield type assembly, shown in open position, mounted on the helmet by means of a peripheral shield.
Figure 4:
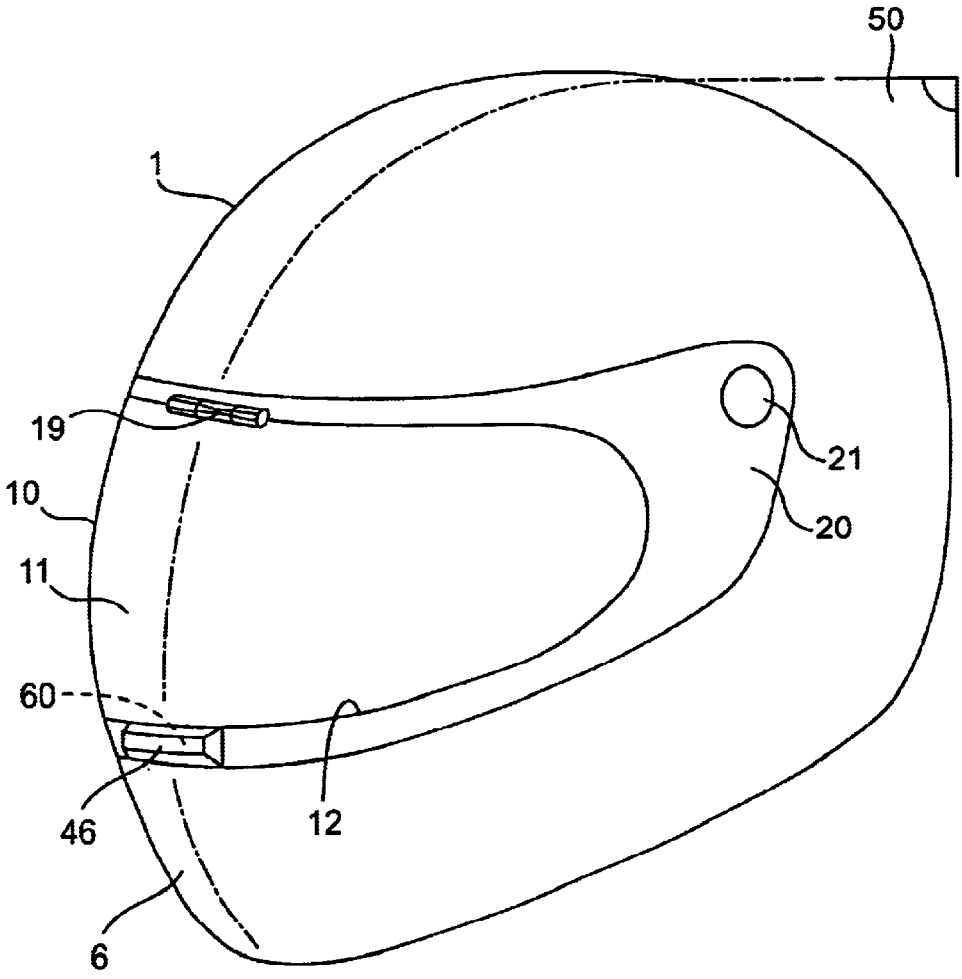
FIG. 4 corresponds to FIG. 3, with the shield in closed position.

The alternative embodiment of FIGS. 3 and 4 differs solely from that of FIGS. 1 and 2 in that shield 10 is mounted so as to pivot, via hinge 19, on a peripheral shield 20 removably mounted, manually, on helmet 1. Peripheral shield 20 constitutes an adapter for mounting shield 10 on helmet 1. Shield 10 thus forms the equivalent of a mobile panel cut out of a complete conventional shield 10, 20, connected to helmet 1 by two opposite hinges 21 (only one of which is visible) at opposite rear upper corners, at ear level. Conventionally, composite shield 10, 20 can be removed from helmet 1 or swung upwards en bloc, to a visor position.

To the work performed by the wind on opposed shield 10, such as to displace it, there can also be opposed a restoring force resulting from energy that has been stored or from the force of gravity exerted on shield 10.

As a variant in respect of the different figures, shield 10 could swing towards one side of helmet 1, with, for example, a substantially vertical axis of rotation offset in relation to median plane 50.

As a further variant, the mounting members comprise hinge support members (21) (not drawn, of the rear hinge 21 type) disposed, for example, on a rear part of lower edge 12, in such a way that shield 10 has a centre of gravity G mobile in a cantilever position, i.e. located ahead of the hinge support members (21), in relation to the longitudinal direction of arrival of the wind, so that the force of gravity biases shield 10 to swing downwards towards the rest position, against the pressure of the wind that tends to bias shield 10 to swing upwards.

Provision could also be made, in addition to, or in place of, a rotation, a translation movement of shield 10. The mounting members then comprise translation members for shield 10 arranged so that shield 10 has a mobile centre of gravity G, biased by the force of gravity towards a lower position, corresponding to the rest position of shield 10, in which it remains sensitive to the wind so that it is returned to the closed position by the return of centre of gravity G to a upper position through the action of the wind.

To reach the rest position, at a reduced solid angle, this translation can be directed forwards and/or be lateral, towards one side or upwards or downwards, in relation to a substantially longitudinal line of sight V.

Figure 5:
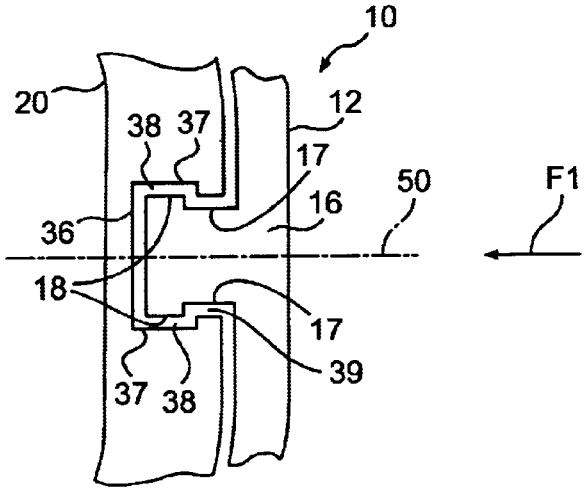
FIG. 5 is a top view of a first device for locking the shield in closed position.

FIG. 5 is a cross-section in partial top view illustrating a first exemplary embodiment of a device for locking shield 10 in closed position according to any one of the forms of embodiment. The peripheral support shield 20 comprises in the lower part (or alternatively, the lower edge 2 of helmet 1) a housing 36 with a forward facing opening, penetrated by an appendix 16, facing rearwards, integral with the lower edge 12 of shield 10. Assembly 36, 16 is symmetrical here in relation to the median plan 50. Arrow F1 indicates the longitudinal direction of the wind, towards the rear, and also the direction in which shield 10 is pulled down.

Housing 36 comprises a mouth 39 of reduced width, while two zones of lateral walls 37 of housing 36, globally parallel to median plane 50, form the respective bottoms of two opposed lateral cavities 38, in relation to which mouth 39 forms two opposed relief portions facing median plane 50. Appendix 16 comprises two lateral faces or surfaces 17, globally parallel to plane 50, comprising two respective lateral relief or protruding portions 18, facing away from plane 50. In the entered, closed position, the lateral relief portions 18 are laterally entirely opposite cavities 38. The distance between the apices of the two relief portions 18 corresponds to the width of mouth 39 of housing 36, plus a slight amount of clearance.

Hinge 19 has some mechanical play so that the lower part 12 of shield 10 can move, or spin, laterally a few tenths of a millimetre in the event of a side wind.

In such a case, relief or protruding portion 18, which moves away from the median plane 50 through the effect of the side wind, penetrates facing cavity 38 and thus locks shield 10 in closed position.

Figure 6A:
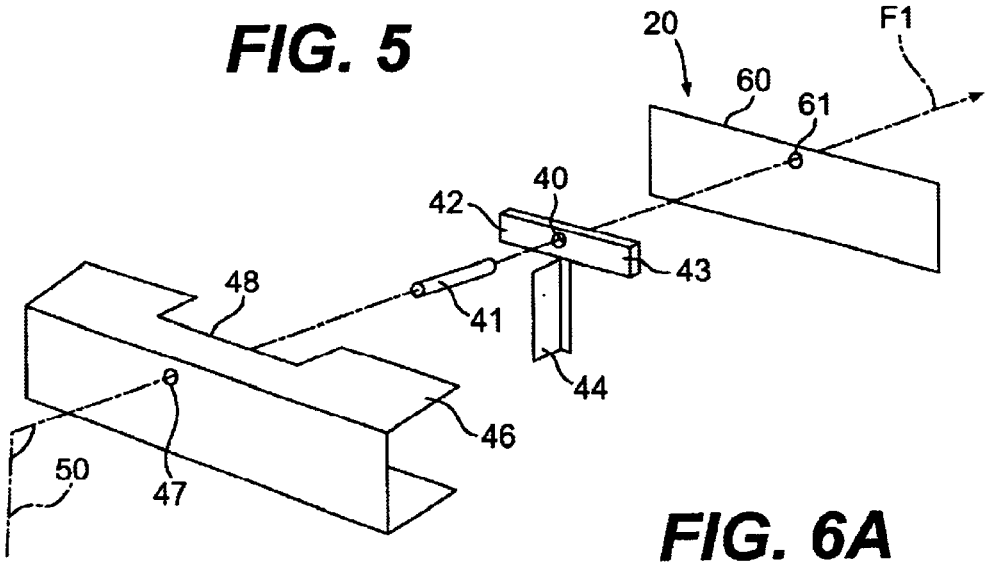
FIG. 6, formed by FIGS. 6A and 6B, shows a second device for locking the shield in closed position.
Figure 6B:
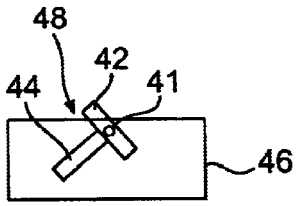

FIG. 6A is a three quarter front exploded view in perspective of a second exemplary embodiment of a device for locking shield 10 in closed position. FIG. 6B is a very schematic front view thereof. A hook, or mobile finger, 42 for locking in closed position, is rotatably mounted to temporarily render shield 10 integral with peripheral shield 20 (or, alternatively, with helmet 1). Finger 42 is rotatably mounted about a longitudinal pin 41. Finger 42 is integral with a rotary vane 44 for actuation by the wind, housed, in this example, in a fairing member 46 (FIG. 4) to channel the wind towards vane 44. Vane 44 extends, in rest position, in median plane 50, and thus perpendicularly to the transverse direction of extension of fairing member 46.

Fairing member 46 has a transverse section in the shape of a U on its side, opening towards the rear, and the edges of the apex of the U are pressed against a zone 60 of the lower part of peripheral shield 20, in order to laterally close the apex of the U of fairing member 46. A first end of pin 41 is borne by the edge of a hole 47 in the upper part of the forward face (the base of the U) of fairing member 46, with a second, opposite, end being borne by the edge of a hole 61 in zone 60. Finger 42 has a hole 40 to allow through pin 41 and suspend vane 44.

Fairing member 46 forms, with zone 6Q, a sort of transverse tube housing vane 44, with finger 42 being able to project therefrom through a slot or cut-out 48 in the upper wall of tube 46, 60, which slot 48 extends longitudinally in relation to tube 46, 60. A lateral gust of wind "cutting across" the head-on wind and liable to cause the untimely raising of shield 10, causes vane 44 (FIG. 6B) to rotate, hence finger 42 to project, through slot 48, in the locked position. For operation in both directions of rotation of vane 44, there are, in fact, two opposing fingers, 42 and 43, i.e., vane 44 forms the trunk of a T suspended at the intersection of its trunk with its arms 42, 43 forming locking fingers or cams. The above locking assembly can be mounted on the lower part 6 of helmet 1 or of shield 20, and then finger 42 or 43 rotates upwards in front of the lower edge 12 of shield 10, thus locking it.

Alternatively, the above locking device could be mounted on shield 10, in the area of a zone of lower edge 12 replacing zone 60, so that finger 42, 43, by rotating from its rest position, projects downwards, the T 42,43, 44 then being suspended, turned over, to fasten onto the inner edge of shield 20 or the lower part 6 of helmet 1.

Figure 7:
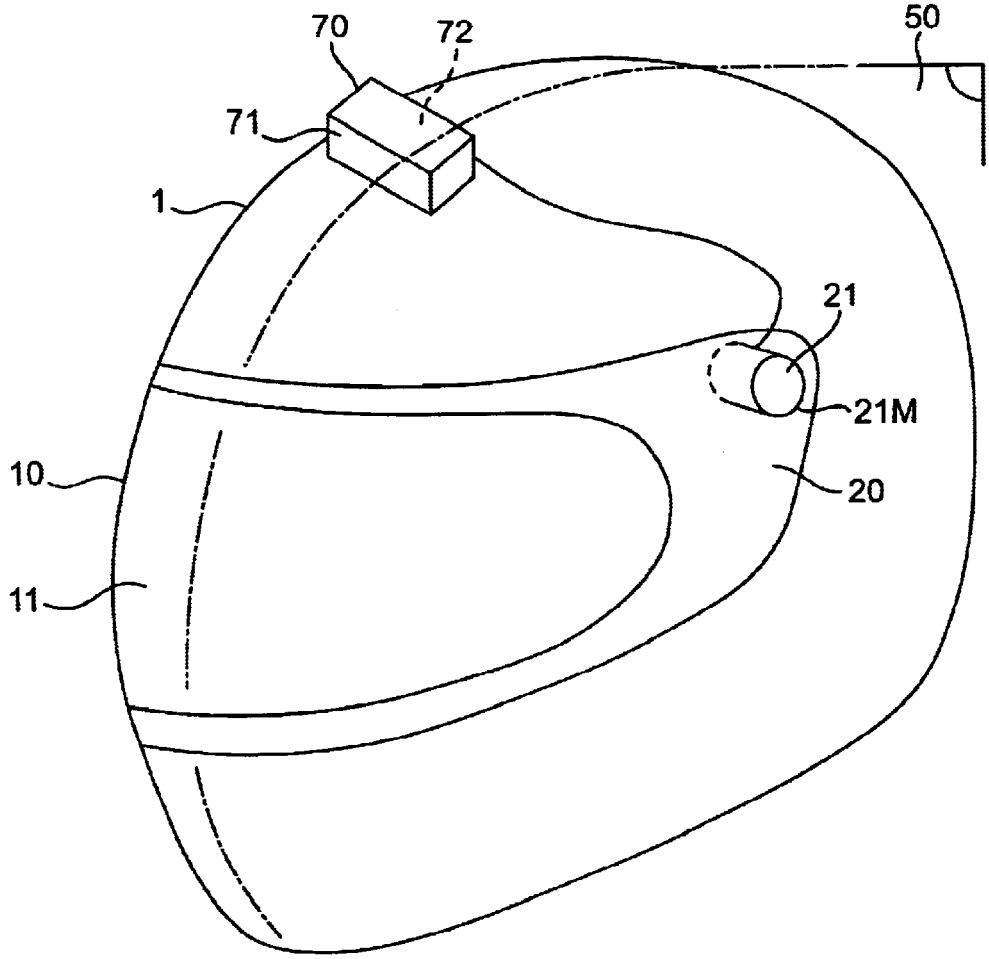
FIG. 7 is a view of the third form of embodiment, corresponding to that of FIG. 4, with a motor for actuating the shield.

FIG. 7 shows the third form of embodiment of the shield-equipped helmet. This example corresponds to the example in FIG. 4, but shields 10 and 20 form a single-piece assembly, mounted so as to hinge on helmet 1 via hinges 21. Reference number 10 denotes the transparent part of shield 10, 20 and reference number 20 denotes the peripheral frame part serving as an adapter for mounting on helmet 1. Unlike a conventional shield, shield 10, 20 is associated with an actuating motor 21M designed to move shield 10 from one to the other of its functional positions, here end positions, for example from the closed position, shown here, to the open position, in which shield 10 has pivoted upwards about hinges 21 to form a sort of substantially horizontal visor. Motor 21M is powered by a battery, forming here a one-piece assembly therewith.

Motor 12M is, here, a rotary motor, centred on one of the hinges 21 and controlled by a device 70 for measuring the pressure of the relative wind, a comparator 72 of which compares the measured value of pressure with a reference threshold and commands rotation of motor 21M in a predetermined direction when the threshold is crossed in a predetermined direction. Device 70 functionally belongs to the assembly comprising shield 10, 20 and its mounting members 21 with motor 21M; however, device 70 could be mounted independently of the other parts of this assembly. Device 70 is thus, in this example, fixed on the upper part of helmet 1, and precisely opposed to the wind, i.e. facing in the longitudinal direction of arrival of the wind.

In a first exemplary case, and as regards control of motor 21M, if the measured value increases to the point of crossing the threshold, device 70 commands rotation of motor 21M in the direction of descent of shield 10, 20 into the closed position. The return from the closed position to the open position can be controlled by elastic return bias, for example by one or two spiral or coil springs mounted at the respective hinges 21. In place of, or as a complement to, the above springs, provision can be made for the force of gravity to act but, in this case, with a shield 10 that would, for example, be pivotally mounted on helmet 1 or on shield 20, according to the principle of FIGS. 1 and 2, with motor 21M then being located, for example, in the area of hinge 19.

Conversely, in a second exemplary case, device 70 is designed to control the changeover from the closed position to the open position, when wind pressure drops below the threshold. Shield 10, 20 must remain sensitive to the wind, even in open position, so that the wind pulls it down, by direct mechanical control, to the closed position when the threshold is crossed. Shield 10, 20 thus constitutes a wind pressure sensor.

In these first and second cases, swinging in a predetermined direction occurs when the reference threshold of device 70 is crossed in said direction, while swinging back in the opposite direction is associated with the sensitivity to the wind of shield 10, 20 in the position reached under the control of device 70, the closed or open position respectively. The pressure force for swinging back can thus correspond to a mechanical swinging threshold of a value different from that of the threshold stored in the memory of device 70. Preferably, the mechanical threshold is higher than the threshold of device 70 in order to produce a hysteresis effect, preventing shield 10, 20 from oscillating.

Comparator 72 can, however, also function in both directions, to command a return to the initial position, opposed to the above predetermined direction.

Device 70 can be a purely mechanical element, comprising, for example, an elastically deformable membrane 71, extending in a transverse vertical plane in relation to the direction of arrival of the wind to present an apparent, transverse surface, or maximum, hence constant, profile, in order to ensure precise measurement by having optimum sensitivity to pressure. Membrane 71 commands the movement of a switch contact member (72), not shown, (the equivalent of comparator 72) which controls motor 12M when the pressure reaches a deformation threshold of membrane 71. The state of the contact (72) determines the direction of control of motor 21M, or else there are provided two such membrane type assemblies, with different thresholds for controlling motor 21M in both respective directions, with hysteresis.

As a variant of above membrane 71, there can be provided a rotary vane arrangement of the vane 44 type. The movement of the rotary vane (such as 44) can be slowed down by coupling it with a viscous product, such as glycerine, the viscous friction of which necessitates the operation of a force. This viscous product thus has a function of integrating the pressure force of the wind, thus filtering its temporary variations.

As a variant of (over)pressure detection, there can be provided, for the same purpose, depression detection in a venturi, with the intensity of this depression also representing the speed of the relative wind. In such a case, above membrane 71 or its equivalent, again presents, through a housing bearing it, a maximum transverse profile, opposing the passage of the wind, even if the useful surface of sensor member is then facing rearwards, i.e. according to the initial direction of the wind.

Actuating motor 21M is, here, of the stepping type in order, in the absence of a command, to lock shield 19, 20 in the last position commanded, possibly an intermediate one, as explained below.

Alternatively, device 70 is of the electrical or electronic type, for example an integrated circuit 70 integrating membrane 71, on which is plated a conductive ink track constituting a calibrated resistor of a strain gauge mounted in a Wheatstone bridge. The unbalance voltage of the bridge, representing the wind pressure, is applied to an input of the comparator circuit 72, which receives the pressure threshold value at another input, from a storage element. Comparator circuit 72 drives motor 21M according to the direction of level inequality between its two inputs, according to the control principles explained earlier.

An integrator circuit, at the input or the output of comparator circuit 72, can be provided to filter pressure fluctuations.

Comparator circuit 72 is an integrated circuit, having a memory and a microprocessor, programmable by a user to fix a plurality of pressure threshold values, some of which correspond to intermediate open positions of shield 10, which, thanks to stepping motor 21M, can thus take up a semi-open position in a range of intermediate speeds, for example from 20 to 30 km per hour (12.5 to 18.75 miles per hour).

What is claimed is:

1. An eye shield assembly, disposed with respect to an aperture in a helmet, said assembly comprising:

means for pivotally mounting the shield on said helmet between a functional position defining a first solid angle of vision with protection for the user's eyes, and a rest position defining a second solid angle, smaller than said first solid angle;

wind pressure sensing means disposed to control the position of said shield between said functional position and said rest position from air flow outside said helmet;

control means associated with said wind pressure sensing means, said control means having a first pressure threshold causing said shield to pivot from the functional position to the rest position and a second pressure threshold causing said shield to pivot from the rest position to the functional position; and means for pivoting the shield from the functional position to the rest position and from the rest position to the functional position in response to said control means.

2. The assembly according to claim 1, wherein said control means includes hysteresis between the functional position and the rest position.

3. The assembly according to claim 1, in which said control means comprises a programmable integrated circuit programmable to provide a plurality of pressure threshold values.

4. The assembly according to claim 1, wherein gravity biases said shield towards the rest position.

5. The assembly according to claim 4, wherein said means for pivotally mounting the shield are disposed on the upper edge of the forward portion of said shield, said shield including two rearwardly extending lateral parts, said shield being suspended such that the center of gravity of said shield in the functional position exerts a moment about the pivotal mounting of said shield towards the rest position.

6. The assembly according to claim 1, wherein the means for pivotally mounting the shield comprise a hinge, said shield having center of gravity located forward of the hinge in relation to the direction of the wind to bias the shield towards the rest position with the pressure of the wind tending to bias the shield upwards.

7. The assembly according to claim 1, including a peripheral shield over said aperture, said peripheral shield being pivotally mounted thereto.

8. The assembly according to claim 1, wherein said shield has a center of gravity positioned such said shield is biased by gravity toward a lower position toward said rest position, said shield being biased towards an upper position by raising said shield to said functional position by wind pressure on said shield.

9. The assembly according to claim 1, wherein said means for pivotally mounting the shield on said helmet permit lateral displacement of the shield.

10. The assembly according to claim 1, including wind actuated locking means for locking said shield in said functional position in response to wind pressure.

11. The assembly according to claim 10, in which the locking means includes an aperture for receiving a locking member, there being sufficient clearance within said aperture to allow said locking member to move laterally within said aperture when said shield moves between said functional position and said rest position under the influence of wind impinging on said helmet in the lateral direction.

12. The assembly according to claim 10, in which the locking means comprise a movable finger, associated with a wind actuated rotating vane, said locking means locking said shield in a predetermined position with respect to said helmet in response to wind pressure.

13. The assembly according to claim 12, comprising a fairing for channelling the wind towards said wind actuated rotating vane.

14. An eye shield assembly, disposed with respect to an aperture in a helmet, said eye shield having an inner surface facing said aperture and an outer surface, said assembly comprising: a hinge connecting said eye shield to said helmet, said hinge allowing rotation of said eye shield between a closed position over said aperture, and a partially open position allowing air flow into said aperture and over said inner surface of said eye shield, the center of gravity of said eye shield being offset from the axis of rotation of said hinge to bias said shield toward the open position the center of gravity of said eye shield, when air flow is zero, being directly below the axis of rotation of said hinge such that said eye shield is in said partially open position, said offset and the weight of said eye shield being such that wind pressure on said outer surface of said eye shield, above a threshold value, moves said eye shield to said closed position.

15. The assembly according to claim 14, wherein said hinge on said helmet permits lateral displacement of said eye shield.

16. The assembly according to claim 14, wherein said assembly includes a wind actuated locking means for locking said eye shield in said closed position in response to wind pressure.

17. The assembly according to claim 14, wherein said assembly includes at least one spring associated with said hinge, said at least one spring biasing said eye shield toward the open position.

* * * * *